US005358627A

United States Patent [19]

Mears et al.

[11] Patent Number: 5,358,627

[45] Date of Patent: Oct. 25, 1994

[54] HYDROPROCESSING FOR PRODUCING LUBRICATING OIL BASE STOCKS

[75] Inventors: David E. Mears, Fullerton; Michael G. Hunter, Downey, both of Calif.

[73] Assignee: Union Oil Company of California, Los Angeles, Calif.

[21] Appl. No.: 828,728

[22] Filed: Jan. 31, 1992

[51] Int. Cl.[5] ..... C10G 45/08

[52] U.S. Cl. ..... 208/59; 208/95; 208/100

[58] Field of Search ..... 208/59

[56] References Cited

U.S. PATENT DOCUMENTS

| | | | |
|---|---|---|---|
| 3,682,813 | 8/1972 | Dun | 208/96 |
| 3,723,295 | 3/1973 | Kress | 208/96 |
| 3,790,472 | 2/1974 | White | 208/59 |
| 4,011,154 | 3/1977 | Stangeland et al. | 208/93 |
| 4,283,271 | 8/1981 | Garwood et al. | 208/59 |
| 4,283,272 | 8/1981 | Garwood et al. | 208/59 |
| 4,347,121 | 8/1982 | Mayer et al. | 208/59 |
| 4,414,097 | 11/1983 | Chester et al. | 208/59 |
| 4,421,639 | 12/1983 | Lambert et al. | 208/309 |
| 4,501,653 | 2/1985 | Hamner | 208/59 |
| 4,574,043 | 3/1986 | Chester et al. | 208/59 |
| 4,822,476 | 4/1989 | Ziemer et al. | 208/59 |

*Primary Examiner*—Helane Myers

*Attorney, Agent, or Firm*—Gregory F. Wirzbicki; Alan H. Thompson; Charles L. Hartman

[57] ABSTRACT

High quality lubricating oil base stocks are produced from crude oils that contain significant concentrations of aromatic compounds in their higher boiling fractions. First, the crude is fractionated. After the residua fraction has been deasphalted, it is combined with the gas oil fraction. The resultant combined fraction is hydrocracked. The hydrocrackate is separated into a light fraction and a heavy fraction. The heavy fraction is hydrodewaxed, then hydrofinished. The hydrofinished product is combined with the light fraction and distilled into products including middle distillate fuel products and lubricating oil base stocks. The lubricating oil base stocks have high VI.

28 Claims, 1 Drawing Sheet

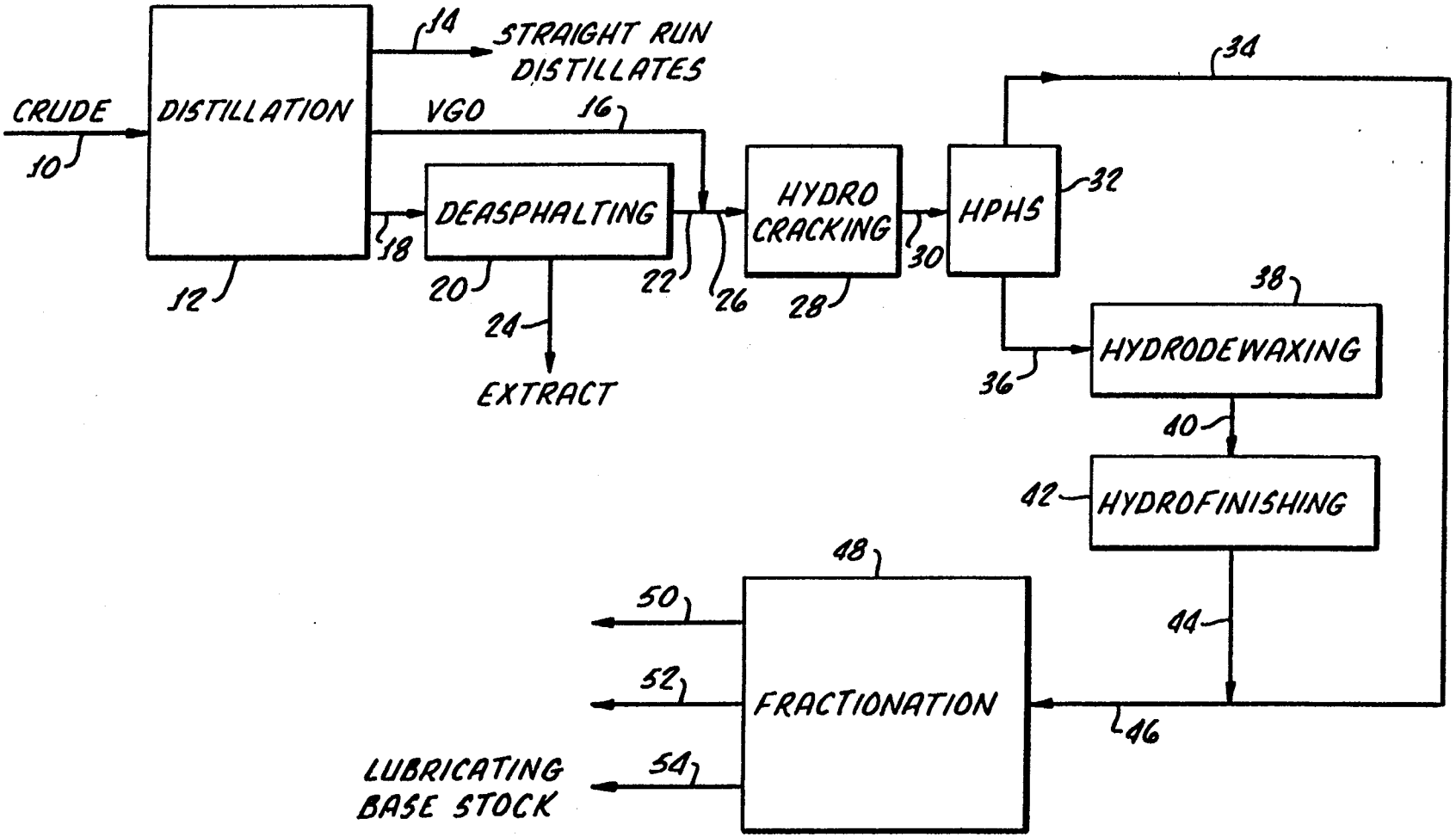
CRUDE
10
DISTILLATION
12
14
STRAIGHT RUN DISTILLATES
VGO
16
18
DEASPHALTING
20
24
EXTRACT
22
26
HYDRO CRACKING
28
30
HPHS
32
34
36
HYDRODEWAXING
38
40
HYDROFINISHING
42
44
46
FRACTIONATION
48
50
52
54
LUBRICATING BASE STOCK

HYDROPROCESSING FOR PRODUCING LUBRICATING OIL BASE STOCKS

BACKGROUND OF THE INVENTION

1. Field of the Invention

This invention relates to methods of producing high quality lubricating oil stocks, particularly to methods of producing high quality lubricating oil stocks having high VI by hydroprocessing low quality crude feedstocks.

2. State of the Art

World crude oil supply constraints are requiring refiners to use poorer quality crude oils to produce high quality lubricating oils. High quality lubricating oils must have a high viscosity index (hereinafter VI), low volatility, good low temperature fluidity, and high stability. Some of these properties can be achieved by solvent refining certain high grade crude oils, but these crude oils are becoming less available and more expensive.

The poorer quality crude oils remaining tend to have higher concentrations of aromatic compounds and asphaltenes in the heavier portion of the feedstock containing the components of the appropriate weight to produce neutral base stocks and bright stocks. In hydrocracking, the desired reactions are the saturation of polyaromatics and the opening of polynaphthenic molecules into branched paraffinic molecules. Hydrodewaxing essentially selectively hydrocracks normal paraffins, reducing the molecular weight and length of the molecules. Heavy hydrocarbon stocks, herein defined as those boiling above 650° F., can be processed by hydrodewaxing to produce acceptable lubricating oil base stocks by reducing the molecular weight range of normal paraffins to below the molecular weight range of neutral stocks. Therefore, a poorer quality crude oil can be upgraded to make an acceptable lubricating oil base stock by a combination of hydrocracking and hydrodewaxing.

Poorer quality crude oils are theoretical candidates for a new source of lubricating oil base stocks. However, distillation of such crude oils normally produces poor quality lubricating oil base stocks fractions. The lubricating oil base stocks produced have an unacceptably high concentration of aromatic and naphthenic components, and, consequently, unacceptably low VIs. Hydroprocessing must be used to produce lubricating oil base stocks low in aromatic and naphthenic components. But if commercially acceptable hydroprocessing conditions are employed, then a number of difficulties will be encountered. Among the difficulties is that hydroprocessing the crude oil to remove aromatic components producing a product containing high concentrations of naphthenic components. Naphthenic components are known to degrade the VI of the resulting lubricating oil base stocks. Removal of the naphthenic components by hydroprocessing requires high temperatures and pressures. Furthermore, aromatic components tend to consume large amounts of hydrogen during hydrogenation. If these difficulties could be overcome, then a significant advantage would be gained. Then high quality lubricating oil base stocks could be produced from poorer quality crude oils using commercially acceptable hydroprocessing conditions.

SUMMARY OF THE INVENTION

This invention provides a method for producing high quality lubricating oil base stocks out of crude oils that contain significant concentrations of polyaromatic compounds in their higher boiling fractions.

In a preferred embodiment, high quality lubricating oils are produced from a heavy crude oil containing significant amounts of asphaltenes and polyaromatic components. First the crude oil is fractionated into a light product fraction and a 650° F.+ heavy hydrocarbon fraction that includes a vacuum gas oil fraction and a vacuum residua fraction. In the process of this invention the vacuum residua fraction is cut at a lower temperature than used in conventional commercial practice. This procedure increases the amount of light neutral stock boiling range components in the resulting low cut point residua fraction. Consequently, many polyaromatic components are removed from the vacuum gas oil fraction and appear in the low cut point residua fraction. The low cut point residua is deasphalted with a tuned propane deasphalting step that preferentially removes most aromatic components. Removal of the aromatic components from the low cut point residua removes many of those aromatic components boiling in the normal vacuum gas oil fraction range. Therefore, in the process of this invention, the total amount of polyaromatic components, which are known to degrade lubricating oil quality, are advantageously removed in one step. When the residua fraction and the vacuum gas oil fraction are recombined the resulting product can be hydrocracked into a superior low aromatic lubricating oil feed stock using commercially acceptable conditions.

As stated above, the vacuum residua fraction is deasphalted and dearomatized by a tuned deasphalting step that preferentially removes aromatic components. The tuned step comprises contacting propane with the residua at a weight to weight ratio between about 10 and 20 at an extraction temperature between about 165° F. and 180° F. with an internal temperature change between about 5° and 15° F. The propane deasphalting unit so tuned preferentially rejects the unwanted polyaromatic components. This produces a dearomatized deasphalted oil fraction (DAO) fraction.

The dearomatized DAO fraction is then combined with the vacuum gas oil fraction to produce a low aromatic hydrocracking feedstock. The hydrocracking feedstock is introduced into a hydrocracking vessel and contacted sequentially with a hydrotreating catalyst and then a hydrocracking catalyst under hydroprocessing conditions. The resulting hydrocrackate is introduced into a high pressure, high temperature separator and a heavy fraction is separated from a light fraction. The light products include not only the light hydrocarbons produced in the hydrocracking step, but most of the ammonia and hydrogen sulfide produced as well. The heavy fraction is hydrodewaxed, and the product from the hydrodewaxing step is hydrofinished. The product from the hydrofinishing step is combined with the light fraction separated from the separation step, and the product formed is distilled, producing separate streams of middle distillate fuels, boiling in the 300° F.–700° F. range, and heavier lubricating oil base stocks.

The process of this invention allows a refiner to use poorer quality crude as a feed for high quality lubricating oil base stocks. The propane deasphalting step removes polyaromatic components, thereby requiring less hydrogen to be used during the hydroprocessing steps while producing high VI lubricating oil base stocks. The separation of the lighter weight fraction after hydrocracking provides for an integral system to hydrotreat and fractionate the lubricating oil base stocks.

Another embodiment of this invention provides a method for producing lubricating oil base stocks from crude oil feedstocks containing more than 25 wt % saturated components. The feedstock is first hydrocracked followed by separation into a light fraction and a heavy fraction. The heavy fraction is hydrodewaxed, and the hydrodewaxed product is hydrofinished. The light fraction is combined with the hydrofinished product. The combined product is distilled to produce middle distillate fuels and lubricating oil stocks.

BRIEF DESCRIPTION OF THE DRAWING

The FIGURE shows a schematic flow diagram of a preferred embodiment of the invention.

DETAILED DESCRIPTION OF THE INVENTION

Referring to FIG. 1, a crude oil in line 10 is distilled in distillation column 12. The crude oil will typically be a poorer quality crude oil, although high quality crude oils are acceptable as feeds in the process of this invention. If a poorer quality crude is used as the feedstock for this invention, it will contain more than 25% saturated components, preferably more than 35% saturated components, and most preferably more than 40% saturated components. An acceptable poorer quality crude oil will also contain between 10 wt % and 65 wt % polyaromatic components, more usually between 25 wt % and 50 wt % polyaromatic components. It is preferred for the method of this invention that the poorer quality crude a) have less than 50 wt % components that are propane insoluble and b) be suitable to yield a deasphalted oil from the propane deasphalting step hereinafter described comprising at least 50 wt % saturated components. Examples of such crudes include Alaskan North Slope, Cook Inlet, Kuwait, and Intermediate Sweet West Texas.

Usually, the major volume of the crude oil distilled in distillation column 12 forms straight run distillates recovered in line 14. A stream of vacuum gas oil boiling in the range between 650° F. and 900° F., preferably between 750° F. and 800° F., is taken off the distillation column through line 16. A residua fraction boiling at more than 750° F., preferably more than 800° F., but preferably not having a lower cut point of more than 950° F., is taken off the column through line 18. The cut points preferred for dividing the vacuum gas oil fraction from the higher boiling portion of the residua fraction are relatively low compared to those conventionally used in refining, but are preferred in this invention. This allows polyaromatic components that would normally be in the gas oil fraction to be subjected to the tuned propane deasphalting step described hereinafter. This subsequently described process provides a method for removing polyaromatic components from the vacuum gas oil fraction.

The residua fraction is introduced into a propane deasphalting unit 20 tuned to preferentially remove polynuclear aromatic components. Removal of the polyaromatics is important as they are typically hydrogenated to polynaphthenes, which degrade the VI of the finished lubricating oil stock. Removal of polyaromatic components also produces a deasphalted oil easier to hydrocrack and reduces the hydrogen consumption required to hydrocrack the DAO. The propane contacts the vacuum residua feedstock at a propane to vacuum residua ratio between about 10 and 20, preferably between 10 and 15, at an extraction temperature between about 165° F. to 180° F., preferably between 170° F. and 175° F. and at an internal change in temperature between 5° F. and 15° F. A dearomatized DAO stream is removed from the reactor through line 22. An extract stream is removed from the reactor through line 24. The vacuum gas oil stream in line 16 is preferably combined with the dearomatized DAO stream in line 22 and the combination in line 26 is introduced into the hydrocracker 28. The combined feedstock substantially all boils at a temperature greater than 650° F.

The hydrocracker 28, typically operated in downflow fashion, contains a pretreatment bed of hydrotreating catalyst superimposed over a bed of hydrocracking catalyst. The hydrotreating catalyst useful for the pretreatment comprises a hydrogenation component, for example a group VIII metal component and/or a group VIB metal component, generally dispersed on a support. More specifically, the hydrotreating catalyst typically contains between 5 and 50 wt % of a Group VIB metal component (measured as the trioxide) and/or between 2 and 20 wt % of a Group VIII metal component (measured as the monoxide) supported on a suitable refractory oxide. Although alumina is the preferred support, other refractory oxides are also suitable, for example, silica, silica-alumina, silica-magnesia, and silica-titania. The catalyst can be produced by conventional methods including impregnating a preformed catalyst support. Other methods include cogelling, comulling, or precipitating the catalytic metals with the catalyst support followed by calcination. Preferred catalysts contain amorphous oxide supports that are extruded in, for example, clover leaf shapes and impregnated with catalytic metals. The particularly preferred catalyst for the pretreatment bed contains about 4 wt % nickel (measured as NiO) and about 25 wt % molybdenum (measured as $MoO_3$) supported on an amorphous gamma alumina support. This catalyst is disclosed as catalyst A in U.S. Pat. No. 4,686,030, issued to Ward et al., which Patent is hereby incorporated by reference herein in its entirety.

Hydrocracking catalysts typically comprise a support of refractory oxide, generally including a cracking component, for example, a molecular sieve, together with a hydrogenation component, for example, a group VIII metal component and a group VIB metal component, generally dispersed on a support. More specifically, the hydrocracking catalyst typically contains between 5 and 50 wt % of a Group VIB metal component (measured as the trioxide) and/or between 2 and 20 wt % of a Group VIII metal component (measured as the monoxide) supported on a suitable refractory oxide. Preferred Group VIII metal components include nickel and cobalt, and preferred Group VIB metal components include molybdenum and tungsten. Suitable refractory oxides include silica, silica-alumina, silica-magnesia, silica-titania, with alumina being preferred. The support contains a cracking component, for example, between 5 and 90 wt % of a large pore crystalline molecular sieve. Preferred molecular sieves include large pore crystalline aluminosilicates, for example, Y zeolite and LZ-10, a steam stabilized Y zeolite.

Preferred catalysts for the hydrocracking bed comprise a hydrogenation component on a support comprising a crystalline molecular sieve and a dispersion of silica-alumina in an alumina matrix. Such preferred catalysts can be produced, for example, by mixing about 10 wt% powdered LZ-10 that has been ion exchanged with ammonium nitrate to reduce the sodium content to about 0.1 wt % with a dispersion of spray dried, powdered silica-alumina in alumina prepared, for example, as in Examples 3 of U.S. Pat. No. 4,097,365. The dispersion can be made by mixing about 44 parts by weight of a 45/55 silica-alumina graft copolymer and about 56 parts by weight of hydrous alumina gel. The final catalyst support consists of essentially 10 wt % LZ-10 in the hydrogen form, about 70 wt % of a dispersion consisting overall of about 45 wt % silica and 55 wt % alumina, and about 20 wt % Catapal alumina for the binder. The calcined catalyst support (300 gm) is then impregnated with of a solution containing 67 gm of nickel nitrate ($Ni(NO_3)_2.6H_2O$) and 108 gm of ammonium metatung-state (91 wt % $WO_3$). After removing the excess liquid the catalyst is dried at 230° F. and calcined at 900° F. in flowing air. The final catalyst contains 4.1 wt % nickel components (calculated as NiO) and 24.2 wt % tungsten components (calculated as $WO_3$). This preferred catalyst is the same or similar to the catalyst disclosed as Catalyst 2 in U. S. Pat. No. 4,419,271, issued to Ward et al., which Patent is incorporated by reference herein in its entirety.

The hydrocracker contains a hydrotreatment bed and a hydrocracking bed in a volume-to-volume ratio between 0.2 to 5, preferably between 0.5 and 2, and most preferably between 0.9 and 1.1. It is maintained at a temperature between 450° F. and 750° F., preferably between about 550° F. and 650° F., and a pressure between 1500 and 2500 psia, preferably between 1500 and 2000 psia. The feed is passed through the hydrocracker at an overall space velocity between 0.5 and 1.0 LHSV. The hydrocracking reactions convert over 20 vol %, usually between 20 and 75 vol %, preferably between 22 and 50 vol %, and most preferably between 25 and 35 vol %, of the feedstock into material boiling at temperatures less than 650° F. The hydrocrackate is removed through line 30.

The hydrocrackate in line 30 passes into a hot, high pressure separator 32. The separator 32 is maintained at a temperature between 400° F. and 550° F., preferably between 450° F. and 500° F., and a pressure between 1500 psia and 3000 psia, preferably between 1750 psia and 2500 psia. Two product streams are formed, a light gaseous fraction, boiling at less than 400° F to 550° F cut point, removed through line 34 and a heavy liquid fraction, boiling at greater than the 400° F. to 550° F. cut point, removed through line 36. The light fraction from this separator contains naphtha and the lightest portions of the middle distillate co-products. Most of the sulfur and nitrogen originally present in the crude as organosulfur and organonitrogen is removed with the light fraction as hydrogen sulfide and ammonia in the hot, high pressure separator.

The heavy fraction in line 36 is introduced into a hydrodewaxing reaction vessel 38 containing a dewaxing catalyst, preferably comprising a dewaxing component, for example an intermediate pore molecular sieve. Preferably, the dewaxing catalyst is a hydrodewaxing catalyst comprising a hydrogenating component on a support containing a dispersion of an intermediate pore molecular sieve in a porous refractory oxide. Examples of such preferred catalysts typically comprise between 5 and 50 wt % of a Group VIB metal component and/or between 2 and 20 wt % of a Group VIII metal component together with a dewaxing component and on a suitable refractory oxide. Preferred Group VIII metals include nickel and cobalt, and preferred Group VIB metals include molybdenum and tungsten. The most preferred hydrogenation component combination is nickel-tungsten. Suitable refractory oxides include silica, silica-alumina, silica-magnesia, silica-titania and the like with alumina being preferred. The catalyst support preferably comprises an intermediate pore crystalline molecular sieve having cracking activity, such as silicalite or the aluminosilicate zeolite ZSM-5. Preferred catalysts include a support comprising the intermediate pore molecular sieve dispersed in an alumina matrix. Such supports can be produced, for example, by extruding a mixture of a 30 wt % molecular sieve dispersion in 70 wt % alumina. The alumina used in the support is a mixture preferably containing between about 50 and 75 wt % gamma alumina and between 25 and 50 wt % peptized Catapal$^R$ alumina. One preferred catalyst comprises about 4 wt % nickel (measured as NiO) and about 22 wt % tungsten (measured as $WO_3$) on a support comprising about 30 wt % of silicalite dispersed in about 70 wt % of the alumina mixture. The preferred catalyst is described in U.S. Pat. No. 4,428,862 issued to Ward et al., which Patent is incorporated by reference herein in its entirety. An alternative preferred catalyst comprises a support of about 80 wt % silicalite dispersed in 20 wt % of the alumina mixture. That alternative preferred catalyst is described in U.S. Pat. No. 4,877,762 (col 18, line 53 to col 19, line 5), issued to Ward et al., which patent is incorporated by reference herein in its entirety.

The operating conditions of the hydrodewaxing reactor include a pressure between about 1,500 and 2,500 psia, preferably between about 1,800 and 2,100 psia, most preferably about 200 psia and a temperature between about 650° to 800° F., preferably between 700° and 750° F., most preferably about 700° F. The feed is passed through the hydrodewaxing reactor at a space velocity between 0.8 and 1.2 LHSV. A hydrodewaxed product is removed through line 40.

The hydrodewaxed product in line 40 is introduced into a hydrofinishing vessel 42. The hydrofinishing catalyst is substantially the same as that previously described for hydrotreating. The preferred hydrofinishing catalyst is Catalyst A as described in U.S. Pat. No. 4,686,030. The hydrofinishing reactor 42 conditions include a pressure between 1,400 and 2,200, preferably between about 1,700 and 2,000 psia, and a temperature between about 500° F. and 650° F., preferably between about 550° F. and 600° F. The feed is passed through the hydrofinishing reactor at a space velocity between 0.5 and 0.6. The effluent from hydrofinishing vessel 42 is removed in line 44.

In one preferred embodiment of this invention, the hydrodewaxing catalyst and the hydrofinishing catalyst constitute separate beds in the same reactor in a volume-to-volume ratio between 0.2 to 5, preferably between 0.5 to 2, and most preferably between 0.9 and 1.1. The operating conditions of the hydrodewaxing bed include a pressure between about 1,500 and 2,500 psia, preferably between about 1,800 and 2,100 psia, and a temperature between about 650° to 800° F., preferably between 700° and 750° F. The operating conditions of the hydrofinishing bed include a pressure between 1,400 and 2,200, preferably between about 1,700 and 2,000 psia, and a temperature between about 500° F. and 650° F., preferably between about 550° F. and 600° F. The feed is passed through the reactor at an overall space velocity between 0.6 and 0.9. This embodiment allows the hydrodewaxed product to be immediately hydrofinished.

The light fraction in line 34 is combined with the hydrofinished product, and the combined product in line 46 is introduced into a fractionation column 48. The combined hydrocarbon stock is distilled in fractionation column 48, forming a light fuel product stream removed through line 50, a middle distillate product stream, useful for blending to make middle distillate fuels, removed through line 52, and a heavier lubricating oil product stream, useful for subsequent vacuum distillation into lubricating oil base stocks, removed through line 54. It is preferred that the lubricating oil base stock fraction be further fractionated into neutral base stocks and bright stock.

The middle distillate blending stocks have an aromatic content of less than 10 wt %, preferably less than 5 wt %. The lubricating oil stocks produced after vacuum distillation have a high VI, between 90 and 140, preferably between 95 and 100. The resulting lubricating oil stocks consequently show low volatility. The light and medium neutrals obtained from fractionation of the lubricating oil base stock have a low pour point of about −10° F. and also have excellent low temperature fluidity. The heavy neutral and bright stock have somewhat higher pour points but have lower pour points than the specifications requiring a 15° F. pour point for heavy neutral and bright stocks.

The invention is further described by the following example which is illustrative of various aspects of the invention and are not intended as limiting the scope of the invention as defined by the appended claims.

EXAMPLE

In this example Alaskan North Slope (ANS) crude oil is used to produce an acceptable lubricating oil stock.

About 70,000 barrels per day of ANS crude oil containing about 1 weight percent sulfur is distilled in a conventional manner and the straight run distillates are removed. The upper cut point for the vacuum residua portion is about 800° F. In a typical ANS crude oil, approximately 8,700 barrels per day of vacuum gas oil boiling between 650° F. and 800° F. are produced and approximately 21,000 barrels per day of residua are produced. The 800° F.+ residua cut is subjected to propane deasphalting.

The propane deasphalting unit operates at a propane-to-oil ratio of about 13 at an extraction temperature of 175° F. and a top delta T of 10° F. The propane deasphalting unit so tuned not only removes the asphaltenes, but also polyaromatic molecules in the heavy portion. The propane deasphalting unit produces about 13500 barrels per day of dearomatized DAO.

The DAO from the deasphalting unit is combined with the vacuum gas oil fraction to produce a hydrocracker feed blend. The compositions of the VGO, the DAO, and the hydrocracker feed blend are shown in Table 1.

TABLE 1

ANS DAO/VGA HYDROCRACKING-HYDRODEWAXING
Feedstock properties

| Component | VGO 600°-800° F. | DAO 800° F.+ | Blend |
|---|---|---|---|
| Vol. % | 30 | 70 | 100 |
| Gravity, API | 21.9 | 20.9 | 21.2 |
| Sulfur, wt. % 0 | 0.941 | 1.2 | 1.12 |
| Nitrogen, wt. % | 0.0937 | 0.170 | 0.147 |
| Oxygen, wt. % | 0.0532 | 0.255 | 0.195 |
| Conradson Carbon, wt. % | 0.1 | 1.9 | 1.36 |
| Metals, Ni + V, ppm | 0 | 3 | 2 |

The hydrocracker is maintained at a pressure of 2,200 psia and a temperature of 750° F. The feedstock is passed through the reactor at an overall space velocity of 0.7 LHSV. The feed passes serially through two catalyst beds of equal weight in the reactor, the first, a bed of the catalyst identified as Catalyst A in U.S. Pat. No. 4,686,030, and the second, a bed of the Catalyst 2 in U.S. Pat. No. 4,419,271 (except that NiO is 5 wt % and $WO_3$ is 22 wt %). The feedstock is hydrocracked with about 30 volume percent conversion to a component fraction boiling at less than 650° F.

The effluent from the hydrocracker is introduced into a hot, high pressure separator operating at about 2,100 psia and at about 475° F. All the light hydro-carbons, that is, those components boiling in the naphtha range and the light boiling middle distillate components having a boiling point less than about 550° F. (atmospheric), as well as substantially all the hydrogen sulfide and ammonia produced in the hydrotreating and hydrocracking steps, are separated from the liquid, heavier hydrocarbon fraction.

The liquid, heavier hydrocarbon fraction (550° F+) is then introduced into a catalytic hydrodewaxing reactor. The reactor is charged with the catalyst described in U.S. Pat. 4,877,762, column 18, which contains a support of 20 wt % alumina and 80 wt % silicalite with the overall catalyst containing 3 wt % NiO and 17 wt % $WO_3$. The hydrodewaxing reactor is maintained at a temperature of 725° F. and a pressure of 1,900 psia. The liquid flows through the reactor at 1.0 liquid hourly space velocity.

The effluent from the catalytic hydrodewaxing reactor is introduced directly into the hydrofinishing reactor. The hydrofinishing reactor is charged with the catalyst described as Catalyst A in U.S. Pat. No. 4,686,030. The hydrofinishing reactor is maintained at a temperature of approximately 575° F. and a pressure of 1,800 psia. The feed passes through the bed of hydrofinishing catalyst at approximately 0.5 LHSV.

The effluent from the hydrofinishing reactor is combined with the hydrocarbons removed with the light fraction from the high pressure, high temperature separator after the hydrocracking step. The combined effluent is first subjected to gas stripping to remove the light gases and then distilled. The atmospheric distillation produces approximately 2,200 barrels per day of light naphtha ($C_5$-185° F.), approximately 2,400 barrels per day of heavy naphtha (185°-350° F.), approximately 4,200 barrels per day of jet fuel (300°-550° F.), and approximately 3,700 barrels per day of diesel blending stock (550°-700° F). The heavy fraction from the atmospheric distillation is distilled in a vacuum lubricating oil distillation column. Approximately 4,000 barrels per day of light neutral oil are produced, approximately 3,500 barrels per day of medium neutral oil are produced, and approximately 2,500 barrels per day of heavy neutral are produced, as well as approximately 900 barrels per day of bright stock. The light neutral, medium neutral, heavy neutral, and bright stock fractions all have VIs of approximately 95 to 100.

Poorer quality crude oils can be converted to acceptable quality lubricating oil base stocks using the process described above. Polyaromatic component removal from the residua fraction of the poorer quality crude is important. If polyaromatic components are not removed, they tend to be hydroprocessed into polynaphthenic components that degrade the VI of the lubricating oil base stock. Furthermore, they tend to require more hydrogen and harsher conditions to hydroprocess than naphthenic or paraffinic components. Removing the polyaromatic components from the feedstock greatly improves the quality of both the middle distillate blending stock and the lubricating oil base stock produced, while allowing the use of commercially acceptable hydroprocessing conditions. The process also includes hydrodewaxing and hydrofinishing, as well as a final fraction step to produce high quality lubricating oil base stocks and low aromatic middle distillate blending stocks. A particularly advantageous feature of this process is that the light hydrocarbons produced in the hydrocracking step can be separated from the hydrodewaxing feed stream and combined with the hydrodewaxed and hydrofinished products. This feature prevents excessive hydrocracking of desired middle distillate products and allows a single distillation step to separate all the lighter products (including those formed in the hydrodewaxing and hydrofinishing steps) from the lubricating oil base stocks.

This invention provides a single integral dedicated refining unit, complete with distillation facilities and hydrogenation reactors to produce an acceptable quality lubricating oil base stock from poorer quality crude oils. The various liquid products produced need not be transferred around the refinery. Instead, all liquids produced from all the hydroprocessing steps are combined for a single fractionation step.

Although this invention has been primarily described with reference to an example and the preferred embodiments thereof, it is evident that many alternatives, modifications and variations are apparent to those skilled in the art in light of the foregoing description. Accordingly, it is intended that the spirit and scope of the appended claims embrace all such alternatives, modifications and variations.

What is claimed is:

1. A method for producing lubricating oil base stocks comprising:

hydrocracking a heavy hydrocarbon feedstock comprising essentially all its components boiling above 650° F. under conditions to convert at least 20% of the feedstock into components boiling at less than 650° F. to produce a hydrocrackate product;

separating the hydrocrackate product into a light hydrocarbon fraction comprising middle distillate fuel and a heavy hydrocarbon fraction at a cut point temperature between 400° F. and 550° F., the light hydrocarbon fraction comprising components boiling below the cut point temperature and the heavy hydrocarbon fraction boiling above the cut point temperature;

hydrodewaxing the heavy hydrocarbon fraction;

hydrofinishing the hydrodewaxed product;

combining essentially all the light hydrocarbon fraction with the hydrofinished product; and distilling the combined hydrocarbon to produce a (1) middle distillate fuel blending stock having an aromatic content of less than about 10 wt. % and a boiling range from 300° F. to 700° F. and (2) lubricating oil base stocks.

2. The process of claim 1 wherein the heavy hydrocarbon feedstock comprises between 10 and 90 wt % of a vacuum gas oil having a boiling range between 650° F. and 800° F. and between 10 and 90 wt % of a deasphalted oil fraction.

3. The process of claim 2 wherein the vacuum gas oil has a boiling range between 650° F. and 800° F.

4. The process of claim 1 wherein the heavy hydrocarbon feedstock comprises a deasphalted oil fraction produced from a residua having a lower cut point between 750° and 950° F. and subjected to propane deasphalting to remove both asphaltene components and polyaromatic components.

5. The process of claim 4 wherein the heavy hydrocarbon feedstock comprises between 0.1 and 3.0 wt % sulfur and between 100 and 20,000 ppmw nitrogen.

6. The process of claim 1 wherein the light hydrocarbon fraction further comprises substantially all hydrogen sulfide and ammonia produced from the hydrocracking step.

7. A method for producing lubricating oil base stocks comprising:

hydrocracking a heavy hydrocarbon feedstock comprising between 10 to 90 wt % gas oil boiling between 500° F. and 900° F. and 10 to 90 wt % of a dearomatized deasphalted oil having a lower cut point between 750° F. and 950° F. under conditions to convert at least 20% of the feedstock into components boiling at least than 650° F. to produce a hydrocrackate product;

separating the hydrocrackate product into a light hydrocarbon fraction and a heavy hydrocarbon fraction in a separator at a temperature between 400° F., the light hydrocarbon fraction comprising middle distillate fuel and boiling below a cut point temperature between 400° F. and 550° F. and said heavy hydrocarbon fraction boiling above the cut point;

hydrodewaxing the heavy hydrocarbon fraction;

hydrofinishing the hydrodewaxed product;

combining the light hydrocarbon fraction with the hydrofinished product; and distilling the combined hydrocarbon to produce a product comprising (1) a middle distillate fuel blending stock having an aromatic content less than about 10 wt % and a boiling range from 300° F. to 700° F. and (2) lubricating oil base stocks.

8. The method of claim 7 wherein the heavy hydrocarbon feedstock contains between 0.1 and 3.0 wt % sulfur and 100 and 20,000 ppmw nitrogen.

9. The method of claim 7 wherein the separating step comprises removing substantially all hydrogen sulfide and ammonia produced in the hydrocracking step with the light hydrocarbon fraction.

10. The method of claim 7 wherein the heavy hydrocarbon feedstock comprises between 50 to 90 wt % deasphalted oil and between 10 to 50 wt % gas oil.

11. The method of claim 7 wherein the heavy hydrocarbon feedstock comprises a crude oil fraction containing between 20 and 80 wt % aromatic components.

12. The method of claim 1 wherein the heavy hydrocarbon feedstock includes no more than 20 wt % aromatic components.

13. The method of claim 10 wherein the lubricating oil base stocks produced contain no more than 20 wt % aromatic components.

14. The method of claim 7 wherein the heavy hydrocarbon feedstock comprises a deasphalted oil fraction produced from a residua having a lower cut point temperature between 750° F. and 950° F. and subjected to propane deasphalting to remove both asphaltene components and polyaromatic components.

15. A method for producing lubricating oil base stocks comprising:

separating a hydrocracked product into a light hydrocarbon fraction comprising middle distillate fuel and boiling below a cut point temperature between 400° F. and 550° F. and a heavy hydrocarbon fraction boiling above the cut point temperature;

hydrodewaxing and hydrofinishing the heavy product;

combining the light hydrocarbon fraction with the heavy hydrocarbon fraction to produce a distillable feedstock; and distilling the distillable feedstock to produce a product comprising (1) a middle distillate fuel blending stock having an aromatic content less than about 10 wt % and a boiling range from 300° F. to 700° F. and (2) lubricating oil base stocks.

16. The method of claim 15 wherein the hydrocracked product is produced from a crude oil fraction having between 20 and 80 wt % aromatic components.

17. The method of claim 16 wherein the hydrocracked feedstock includes no more than 10 wt % aromatic components.

18. The method of claim 15 wherein the lubricating oil base stocks produced contain no more than 20 wt % aromatic components.

19. The method of claim 15 wherein the hydrocracked product is obtained by hydrocracking a hydrocracking feedstock produced by the process comprising:

a) contacting a vacuum residua feedstock having a lower cut point between 750° F. and 950° F. with propane at a propane to feedstock weight ratio between 10 and 20 at an extraction temperature between about 165° F. to 180° F. and at an internal temperature change between 5° F. to 15° F.; and b) separating a hydrocracking feedstock containing a low concentration of asphaltene components and polyaromatic components from a residuum extract fraction produced in step a).

20. The method of claim 15 wherein the feedstock contains between 0.1 and 3.0 wt % sulfur and 100 and 20,000 ppmw nitrogen.

21. The method of claim 20 wherein substantially all hydrogen sulfide and ammonia produced from the hydrocracking step is removed in the separating step.

22. The method of claim 15 wherein the feedstock comprises between 50 to 90 wt % deasphalted oil and between 10 to 50 wt % gas oil.

23. A method for producing lubricating oil base stocks comprising:

fractionating a crude oil feedstock into light distillate, a vacuum gas oil and a residua;

producing a dearomatized deasphalted oil fraction from the residua;

combining the dearomatized deasphalted oil and the gas oil fraction into a hydrocracking feedstock;

hydrocracking the hydrocracking feedstock under conditions to convert at least 20% of the feedstock into components boiling at less than 650° F. and producing a hydrocracked product;

separating the hydrocracked product at a temperature between 400° F. and a pressure between 1,500 p.s.i.g and 3,000 p.s.i.g. into a light hydrocarbon fraction comprising middle distillate fuel and boiling below a cut point temperature between 450° F. and 550° F. and a heavy hydrocarbon fraction boiling above the cut point temperature;

hydrodewaxing and hydrofinishing the heavy hydrocarbon fraction;

combining the light hydrocarbon fraction with the hydrodewaxed and hydrofinished heavy hydrocarbon fraction to produce a distillable feedstock;

gas stripping hydrogen sulfide and ammonia from the distillable feedstock; and distilling the distillable feedstock to produce a product comprising (1) a middle distillate fuel blending stock having an aromatic content less than about 10 wt % and a boiling range from 300° F. to 700° F. and (2) lubricating oil base stocks.

24. The method of claim 23 wherein the crude oil contains between 0.1 and 3.0 wt % sulfur and between 100 and 20,000 ppmw nitrogen.

25. The method of claim 23 wherein the producing a dearomatized deasphalted oil step further comprises:

contacting a vacuum residua having a lower cut point between 750° F. and 950° F. with propane at a propane to feedstock weight ratio between 10 and 20 at an extraction temperature between about 165° F. to 180° F. and at an internal temperature change between 5° F. to 15° F.

26. The method of claim 23 wherein the distillable feedstock contains no more than 0.05 wt % sulfur and 50 ppmw nitrogen.

27. The method of claim 23 wherein at least 30% of the hydrocracking feedstock is converted into products boiling at less than 650° F.

28. The method of claim 23 wherein the distilling step comprises a single distillation step of all the hydrocarbon products produced in the previous steps.

* * * * *

UNITED STATES PATENT AND TRADEMARK OFFICE

CERTIFICATE OF CORRECTION

PATENT NO. : 5,358,627

DATED : October 25, 1994

INVENTOR(S) : David E. Mears and Michael G. Hunter

It is certified that error appears in the above-indentified patent and that said Letters Patent is hereby corrected as shown below:

Column 10, line 42, after "400° F." insert -- and 550° F. --.

Column 11, line 4, replace "10" with -- 7 --.

Column 12, line 20, after "400° F." insert -- and 550° F. --.

Signed and Sealed this

Seventh Day of February, 1995

Bruce Lehman

*Attest:*

BRUCE LEHMAN

*Attesting Officer*

*Commissioner of Patents and Trademarks*